US007000957B2

(12) United States Patent
Lawrence

(10) Patent No.: US 7,000,957 B2
(45) Date of Patent: Feb. 21, 2006

(54) LOCKING WINDOW DEVICE

(76) Inventor: Barry G. Lawrence, 1515 Johnstown Rd., Thomasville, NC (US) 27360-7588

( * ) Notice: Subject to any disclaimer, the term of this patent is extended or adjusted under 35 U.S.C. 154(b) by 0 days.

(21) Appl. No.: 10/728,318

(22) Filed: Dec. 4, 2003

(65) Prior Publication Data

US 2005/0121923 A1 Jun. 9, 2005

(51) Int. Cl.
*E05C 3/04* (2006.01)

(52) U.S. Cl. ..... 292/241; 292/DIG. 7; 292/DIG. 20; 292/DIG. 35; 292/DIG. 47

(58) Field of Classification Search ..... 292/241, 292/DIG. 7, DIG. 20, DIG. 35, DIG. 47; 70/240

See application file for complete search history.

(56) References Cited

U.S. PATENT DOCUMENTS

| | | | | | |
|---|---|---|---|---|---|
| 2,102,901 | A | * | 12/1937 | Laursen | 36/35 R |
| 2,153,605 | A | * | 4/1939 | Williams | 411/531 |
| 2,409,154 | A | * | 10/1946 | Schafer | 242/302 |
| 2,621,947 | A | * | 12/1952 | Markvart | 403/274 |
| 3,735,664 | A | * | 5/1973 | Hermle | 411/531 |
| 4,050,724 | A | * | 9/1977 | Nakanishi | 292/241 |
| 4,736,972 | A | * | 4/1988 | Mosch | 292/204 |
| 5,219,195 | A | | 6/1993 | Lawrence | |
| 5,887,916 | A | * | 3/1999 | Finkelstein et al. | 292/241 |
| 6,112,583 | A | * | 9/2000 | Yamamura | 73/116 |
| 6,457,752 | B1 | | 10/2002 | Miller et al. | |
| 6,568,723 | B1 | * | 5/2003 | Murphy et al. | 292/241 |
| 2003/0151262 | A1 | | 8/2003 | Murphy et al. | |

OTHER PUBLICATIONS

Window Locks EZ Search: Locks & Lock Manufacturers: www.locks-ez.com 4 pages.
Truth Hardware: Welcome to Truth Hardware: www.truth.com 2 pages.
Kaba Ilco: www.kaba-ilco.com 2 pages.

* cited by examiner

*Primary Examiner*—John B. Walsh
(74) *Attorney, Agent, or Firm*—Summa, Allan & Additon, P.A.

(57) ABSTRACT

An improved locking device for sash-type windows is provided. The locking device includes a keeper defining an internal or keeper cavity, a housing defining first and second tier-recess combinations, a solid cam rotatively positioned within the first tier-recess combination, and a washer positioned between the housing interior and the flat top portion of the cam. The second tier-recess combination, or keeper recess, is defined by at least a portion of the housing that engages the keeper, such that the keeper is nestable within (wholly or partially enclosed by) the second tier-recess combination. Attempting to force the cam past the keeper cavity when the locking mechanism is locked results in the distribution of the force across the surface area of the keeper recess. The first tier-recess combination further defines an aperture for mounting a handle to engage and operate the cam.

30 Claims, 4 Drawing Sheets

LOCKING WINDOW DEVICE

FIELD OF THE INVENTION

The present invention relates to a novel window locking device having improved function, including improved strength, security, and durability.

BACKGROUND OF THE INVENTION

Closure mechanisms and locks for windows are known in the art. For many years, windows have utilized various mechanisms to secure closure, primarily for safety, security, and energy efficiency. In particular, double hung window assemblies, which have an upper sash window and a lower sash window mounted within a common frame, have typically used sash locks, which draw the upper and lower sashes together to prevent sliding.

Such sash locks generally incorporate a housing mounted on one sash and a keeper mounted on the opposite sash. A lever or actuator arm handle is mounted atop the housing. The handle serves to move an internal mechanism between locked and unlocked positions. Specifically, the surface of the cam engages a tooth-like protrusion of the keeper in the locked position.

Several problems exist with current sash lock technology. First, the physical force exerted on the engaging surfaces creates an undue amount of stress on all parts of the lock. Failures often occur when the cam breaks at its point of intersect with the tooth-like protrusion or the handle, when the keeper breaks in the vicinity of the tooth-like protrusion, or when the handle breaks during operation.

Second, current lock construction demands exacting alignment of the finished product when installed. If this is not achieved, the security function of the window is compromised (i.e., the mechanism will not engage the keeper and thus lock the window). If only partial alignment is achieved, undue stress will be placed on window and lock components, leading to failure of the window and the lock. This scenario is increasingly likely as the window and surrounding construction ages.

Third, the surface engagement mechanism used by current sash locks can push the window sashes away from one another. Conversely, the mechanism can pull the sashes together with excessive force. The result in either case can be misalignment of the window sashes when the window is locked. This compromises the safety and energy efficiency functions of the window.

Thus, there is a need for improvement of current locking window technology that avoids these shortcomings, yet provides greater security and efficiency benefits.

SUMMARY OF THE INVENTION

It is an object of the present invention to provide an improved locking device, preferably adapted to attach to a window sash rail, that is movable between locked and unlocked positions.

It is a further object of the present invention to provide an improved window locking mechanism. The window includes a window frame with at least one sash movable between open and closed positions.

It is a further object of the present invention to provide an improved window unit having a locking mechanism.

The objectives are realized by providing a locking mechanism that includes a housing, a handle, a cam, a washer, and a keeper. Preferably, the housing, handle, cam, and washer are assembled and held together by a connector, such as a threaded screw. This assembly is mounted on one window sash. The keeper is mounted on the opposite sash in a position to engage the housing.

The housing is constructed to form a recess to fit enclosably over at least part of the keeper. Once the housing and the keeper are in place, the handle rotates the cam into a cavity in the keeper. Compared with current window lock design, this interaction distributes the locking force across a greater surface area of the keeper and the housing. Additionally, this design does not push or pull the sashes out of alignment. Collectively, these result in an improved window unit having a locking device that provides greater security and efficiency.

The improved locking device further includes a one-piece circular washer having spring-like properties in the vertical and horizontal directions, relative to the window sash. The washer is designed to fit in an inset defined by the housing and is held in place by the top of the cam. The handle is mounted through a hole about in the center of the washer. The spring-like properties of the washer provide slight resistance to movement and aid in the audible indication of the unlocked and locked positions. These features prevent unwanted movement of the cam by removing excess "play" or "slack" in the movement and serves to "snap" the handle gently against the housing to provide an audible status indication.

DETAILED DESCRIPTION

Typical embodiments of the claimed invention are described in detail herein. It will be understood that the illustrations are for describing the typical embodiment of the invention and are not intended to limit the invention. Furthermore, such terms as "upward," "downward," "front," "back," "forward," "rearward," "top," "bottom," and the like are used for convenience and are not to be construed as limiting. Like numbers refer to like elements throughout the drawings and specification.

Figure 1:
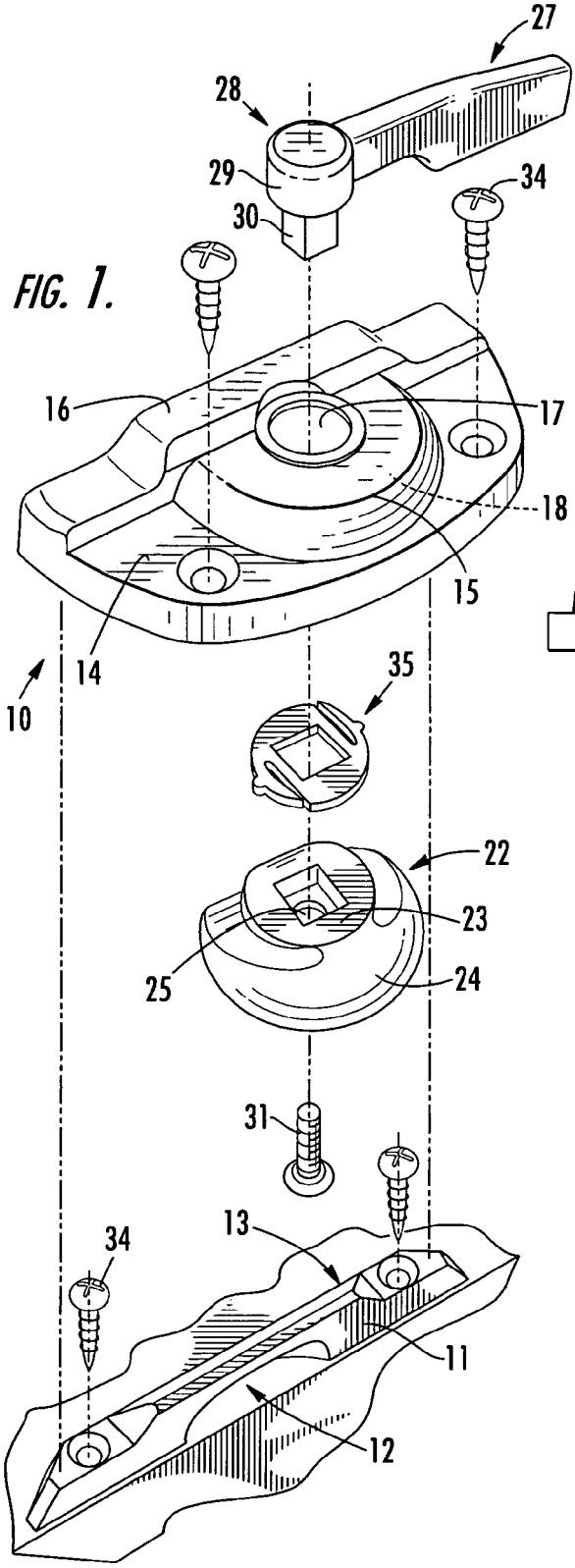
FIG. 1 is an exploded view of the locking device.

In one aspect, the invention is a locking device 10. Referring to FIG. 1, the locking device 10 includes a keeper 11 (or striker) defining an internal cavity 12, a housing 14 having an interior 18 that defines a keeper recess 16, and a cam 22 rotatively positioned within the housing 14. Rotative positioning of the cam 22 refers to the position of the cam relative to the internal cavity 12 of the keeper. The cam may be rotatively positioned between a locked position (FIG. 2) and an unlocked position (FIG. 3). The device 10 further includes a handle 27 mounted through the housing 14, the washer 35, and into the cam 22, with the washer 35 mounted between the housing interior 18 and the cam 22.

The housing 14 includes at least one external tier that corresponds to an internal recess, referred to as a tier-recess combination. A first tier-recess combination 15 accommodates the cam 22, and a second tier-recess combination 16 (keeper recess) accommodates the keeper 11.

Referring again to FIG. 1, the cam 22 is preferably a solid design and substantially D-shaped, including a flat top portion 23. The cam 22 is rotatively positioned within the first tier-recess combination 15 to selectively engage the keeper cavity 12. Accordingly, the radial portions of the cam 24 adjacent the flat top portion 23 may be flattened or textured to better engage the keeper cavity 12. Upon engaging the keeper cavity 12, the cam 22 urges the keeper 11 to engage the keeper recess 16 (second tier-recess combination) within the housing 14. As viewed from its top in FIG. 1, the cam 22 includes a graduated aperture 25 approximately through its center for receiving the handle 27.

Further illustrated in FIG. 1, the handle 27 includes a graduated shaft 28 mounted through the housing 14. The graduated shaft 28 includes a top portion 29 and a bottom portion 30. The bottom portion 30 of the graduated shaft 28 passes through the washer 35 and engages the graduated aperture 25 defined by the cam. The integrity of this structure is maintained with a first connector 31, such as a threaded screw, passing from the bottom of the cam 22 into an opening 32 or blind hole defined by the bottom portion 30 of the graduated shaft. This is further illustrated in FIGS. 2 and 3.

Accordingly, the handle 27 will rotate the cam 22 between a locked position (FIG. 2) and an unlocked position (FIG. 3). Rotation of the handle is a sweeping motion denoted by the arrow 33.

Referring again to FIG. 1, the locking device 10 further includes a washer 35 positioned between the cam 22 and the housing interior 18. Illustrated in greater detail in FIGS. 4–5, the washer 35 is substantially round and resilient to vertical and horizontal compression via the use of vertical and lateral tensioning members.

Figure 4:
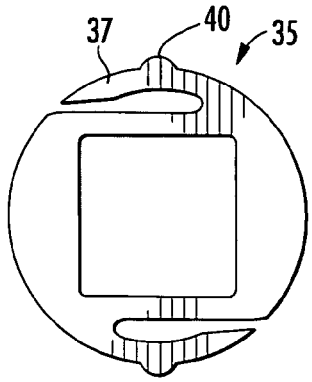
FIG. 4 is a top plan view of the washer.
Figure 4A:
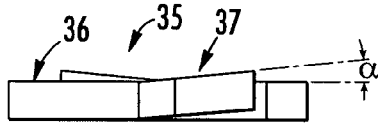
FIG. 4*a* is a side elevated view of the washer.
Figure 4B:
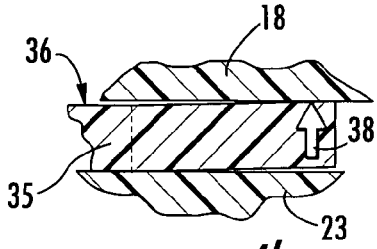
FIG. 4*b* is an enlarged side view of the washer.

Specifically illustrated in FIGS. 4 and 4*a*, the washer 35 includes a vertical tensioning member 37 that defines at least a portion of the circumference of the washer 35. The vertical tensioning member 37 is the portion of the washer 35 raised above the first surface 36 of the washer at an angle $\alpha$ that resists vertical compression. Accordingly, when the locking device 10 is assembled, the vertical tensioning member 37 provides a tensioning force in a vertical direction as shown in FIG. 4*b* by the arrow 38.

Figure 5:
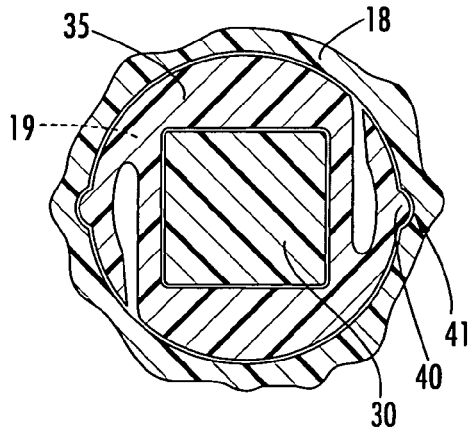
FIG. 5 is a top plan view of the washer showing the horizontal tension means.

FIGS. 4 and 5 show a lateral tensioning member 40 that provides a tensioning force in a horizontal direction.

Specifically, FIG. 5 shows the washer in its position within the housing interior 18. Preferably, this position is an inset 19 defined by the interior of the housing to accommodate and substantially compress the washer 35. The inset 19 is located such that the washer 35 will be mounted between the housing interior 18 and the flat top portion 23 of the cam.

The lateral tensioning member 40 is a lug extending beyond the diameter of the washer 35. The lug is constructed to resist horizontal compression by the inset 19 during movement of the handle 27. The inset 19 defines a notch 41 for correspondingly receiving the lug 40, such that the notch 41 is positioned to relieve the horizontal compression acting on the washer 35 in the fully locked or fully unlocked positions. Furthermore, when the lug 40 engages the notch 41 as shown in FIG. 5, the lug 40 produces an audible indication thereof, such as a snap.

Figure 6:
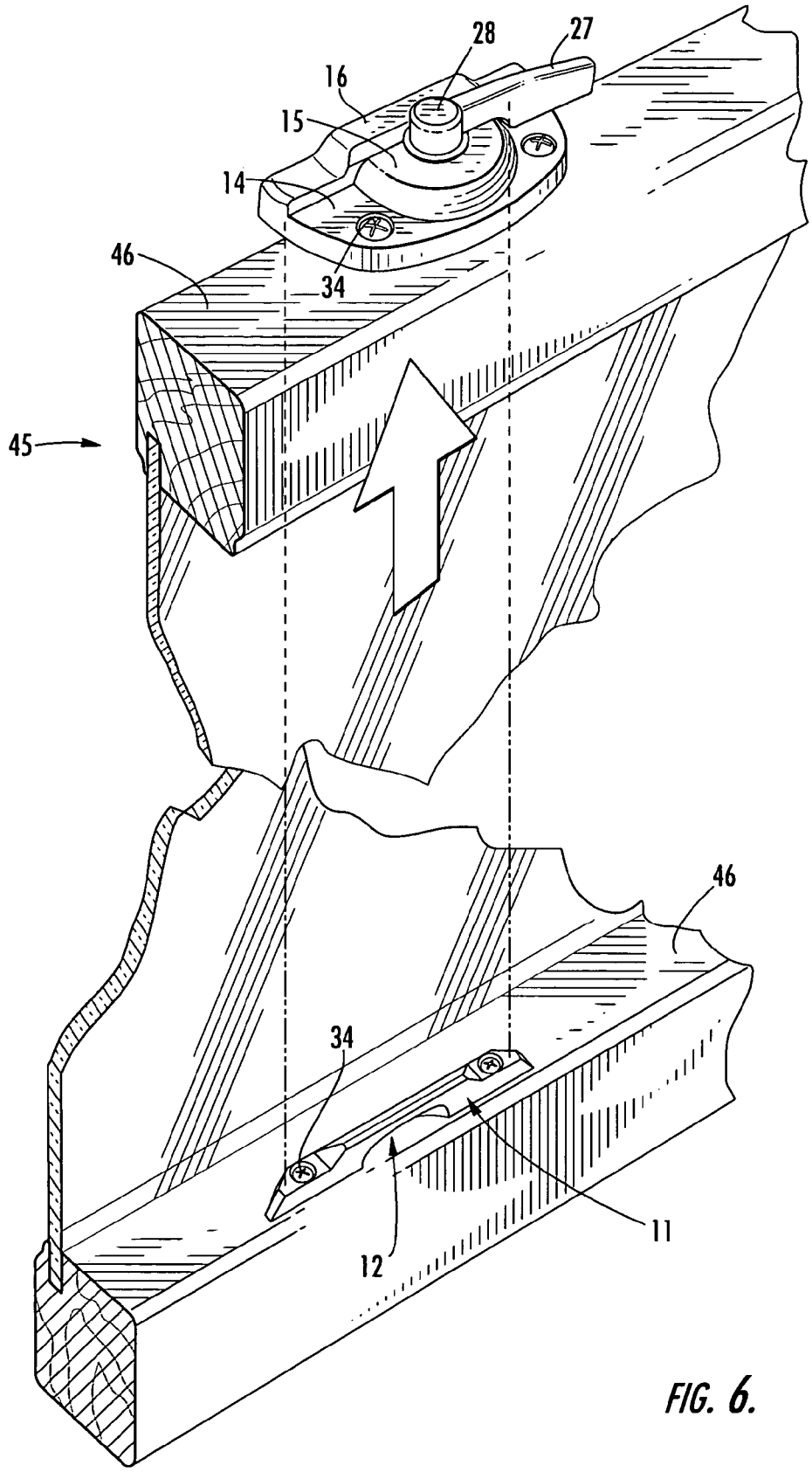
FIG. 6 is a perspective view of the keeper disengaged from the housing of the locking device.
Figure 7:
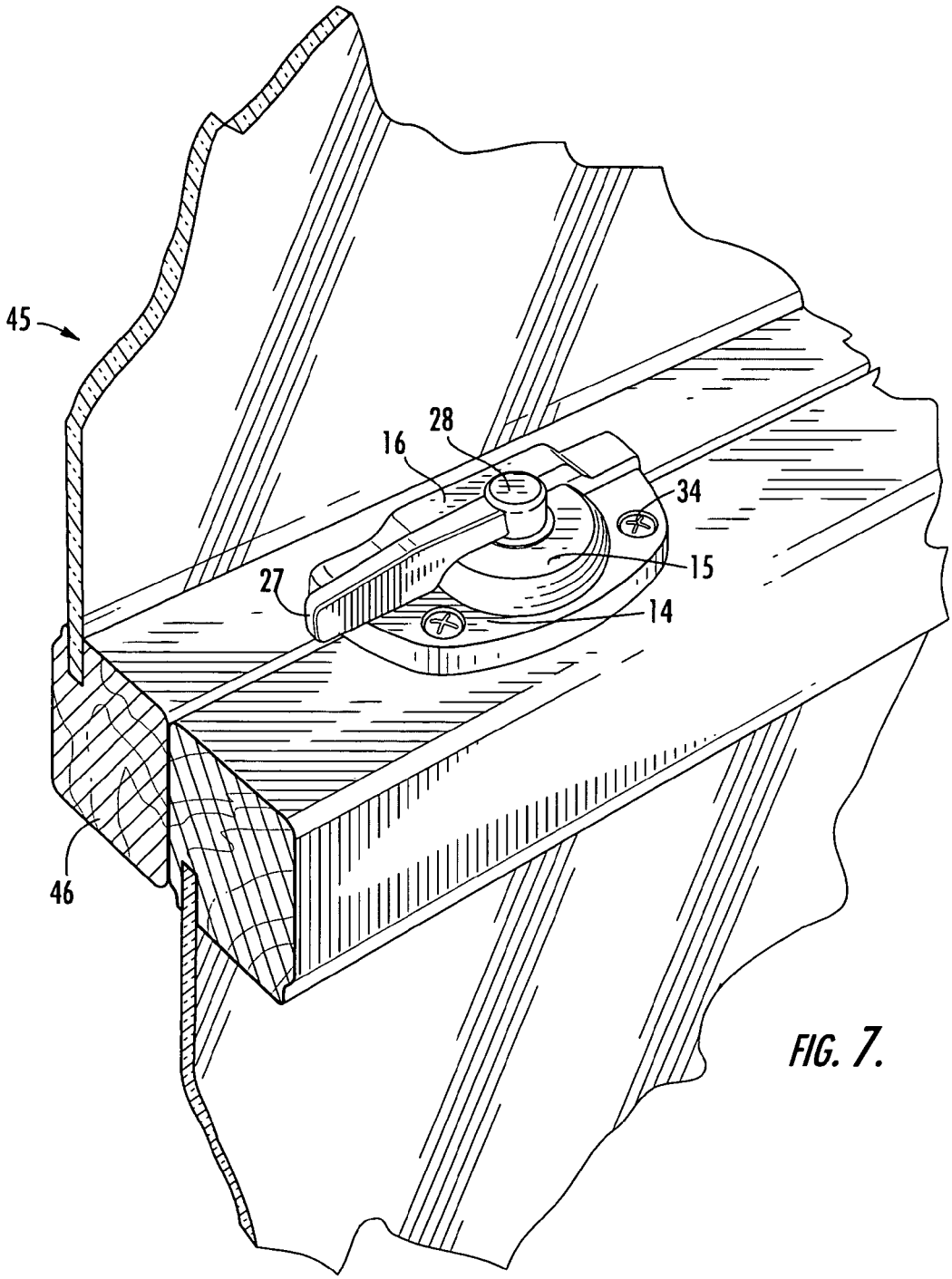
FIG. 7 is a perspective view of the keeper engaged to the keeper recess of the housing.

The assembly and functionality of the device is further shown in FIGS. 1, 6, and 7. In this aspect, the invention is an improved window locking mechanism.

The window locking mechanism 10 includes a keeper 11 defining an internal cavity 12 and a housing 14 defining a keeper recess 16. The window locking mechanism 10 also employs an engagement means for the keeper 11 to engage at least part of the keeper recess 16.

The engagement means serves to urge the keeper 11 to engage the keeper recess 16. By way of non-limiting examples, the engagement means can be a solid cam 22 or a slotted cam (not shown) rotatively positioned within the housing 14, or the engagement means may be a wedge (not shown).

In a preferred embodiment of the window locking mechanism 10, FIGS. 1 and 6 show a raised portion 13 of the keeper 11 for engaging the keeper recess 16. One advantage of the invention is that of the keeper 11 fully engaging the keeper recess 16 such that the keeper is fully enclosed by the keeper recess. Thereafter, the cam can be moved to the locked position without exerting any force on other parts of the lock. Attempting to force the cam 22 past the keeper cavity 12 when the locking mechanism is locked results in the distribution of the force across the surface area of the keeper recess 16.

In the instant invention, at least about 10 percent or more of the surface area of the keeper 11 will engage the keeper recess 16. About 10 percent or more of the surface area of the keeper 11 includes the range of between about 10 and 50 percent, the preferred range of more than about 50 percent, and the most preferred range of the entire surface area of the keeper 11.

In another aspect shown in FIGS. 1, 6, and 7, the invention is an improved window unit 45 having a locking mechanism 10 as described. Specifically, FIGS. 6 and 7 show the window unit 45 in the open and closed positions, respectively. The locking mechanism 10 includes a keeper 11 defining an internal cavity 12, a housing 14 defining first 15 and second tier-recess combinations 16, a cam 22 rotatively positioned within the first tier-recess combination 15, and a washer 35 positioned between the housing interior 18 and the flat top portion 23 of the cam 22. The second tier-recess combination 16 is defined by at least a portion of the housing 14 that engages the keeper 11, such that the keeper 11 is nestable within (wholly or partially enclosed by) the second tier-recess combination 16.

Referring back to FIG. 1, the first tier-recess combination 15 further defines an aperture 17 for mounting a handle 27 as described earlier. The graduated shaft 28 of the handle 27 will engage the graduated aperture 25 of the cam 22 and provide a mechanical advantage for rotative positioning. The assembly of the housing 14, the handle 27 mounted through the aperture 17 into the graduated aperture 25 of the cam 22, and the washer 35 positioned between the housing interior 18 and the flat top portion 23 of the cam 22 is held together by a first connector 31, such as a threaded screw. The first connector 31 is placed in the bottom portion 30 of the graduated shaft 28 of the handle 27, which is adapted to receive a connector 31 (see also FIGS. 2 and 3).

The housing 14 is mounted to a window sash 46 or a window frame (not shown). The keeper 11 is also mounted to a window sash 46 or a window frame (not shown), usually opposite the housing 14. The housing 14 and keeper 11 may be mounted to a window sash 46 or frame (not shown) using a second connector 34, such as a threaded screw. Any suitable material known to those of ordinary skill in the art may be used, however, and include, but are not limited to, rivets, metal or chemical welds, epoxy, or forming the entire window lock device as integral to the window frame or sash, using like materials.

The locking mechanism 10 may be formed of a metal material, including, but not limited to, steel, titanium, brass, pewter, aluminum, or tin, or any alloys thereof. Furthermore, the metal material may be plated or coated to enhance its appearance or to retard oxidation and corrosion. Substances suitable for this purpose include, but are not limited to, zinc, brass, bronze, chrome, or paint.

The locking mechanism 10 may further be formed of a plastic material. Plastic materials are defined by those of ordinary skill in the art as filled engineering materials including 10 to 50 weight percent filler. These include, but are not limited to, fiberglass, fiberglass-reinforced nylon, glass-filled nylon, glass-filled polypropylene, and vinyl. The plastic material may also be coated as above to enhance its appearance.

The locking mechanism 10 may further be formed of metal-plastic combinations. For example, the housing and keeper could be plastic-covered metal, or the keeper and cam could be made of metal and the housing could be made of plastic.

Figure 2:
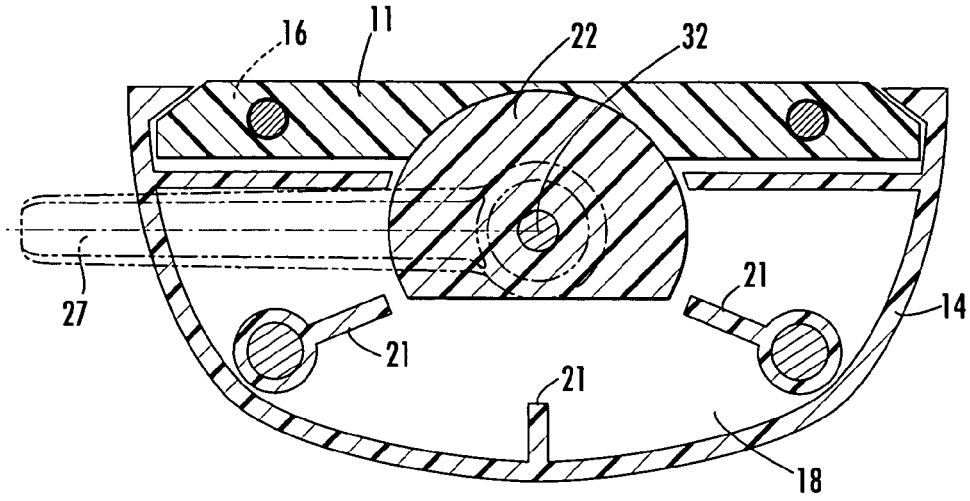
FIG. 2 is a bottom view of the locking device in the locked position.
Figure 3:
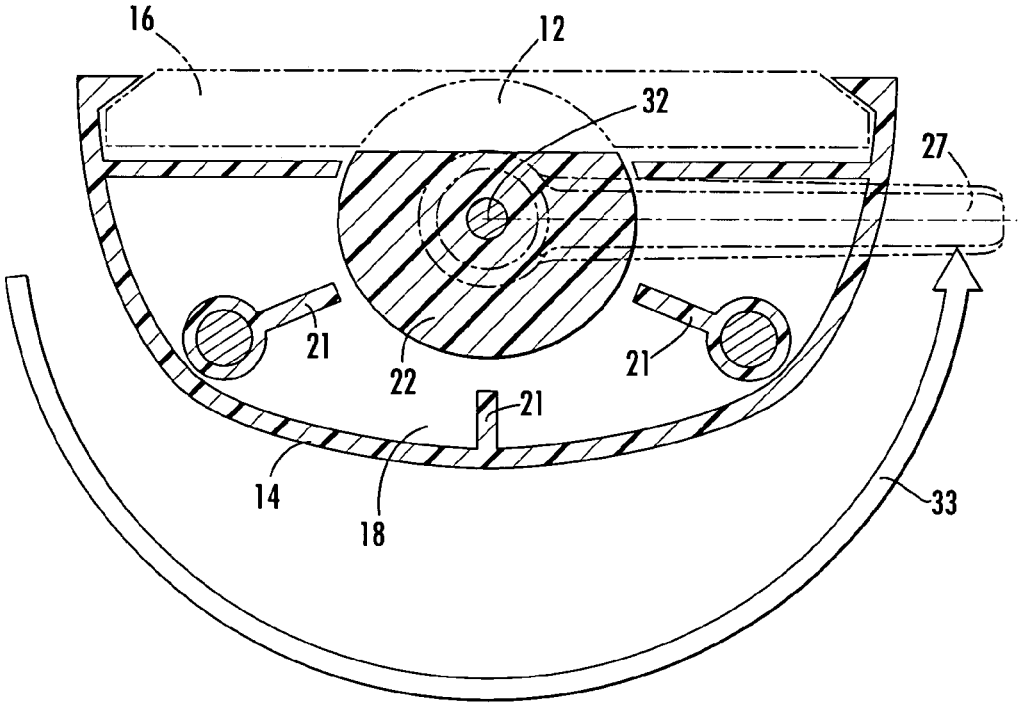
FIG. 3 is a bottom view of the locking device in the unlocked position.

To further enhance the strength and structural integrity of the locking device, FIGS. 2 and 3 show integral supports 21 in the housing interior 18. The supports 21 will typically be of like material as the housing 14.

Those having ordinary skill in the art will appreciate that the locking device 10 can be adapted to secure at least one movable member to a non-movable member. Thus, the invention is useful for many applications in addition to those disclosed herein. For example, a door mounted within a door frame may be secured in the closed position with the invention as described.

In the specification and the drawings, typical embodiments of the invention have been disclosed. Specific terms have been used only in a generic and descriptive sense, and not for purposes of limitation. The scope of the invention is set forth in the following claims.

What is claimed is:

1. A locking device, comprising:

a keeper defining an internal cavity;

a housing defining an interior and an exterior, said housing constructed to form a keeper recess to fit enclosably over at least part of said keeper;

a cam rotatively positioned within said housing; and a washer positioned between said cam and said interior of said housing;

wherein said keeper selectively engages the keeper recess within said housing; and wherein said cam selectively engages said keeper within the internal cavity of said keeper.

2. A device as in claim 1, wherein said keeper includes a raised portion for engaging the keeper recess.

3. A device as in claim 1, wherein said interior further defines an inset for accommodating and substantially compressing said washer.

4. A device as in claim 1, wherein said washer is substantially round.

5. A device as in claim 1, wherein said washer is resilient to vertical and horizontal compression.

6. A device as in claim 1, wherein said washer includes a vertical tensioning member that provides a tensioning force in a vertical direction.

7. A device as in claim 6, wherein said vertical tensioning member comprises a raised portion that resists vertical compression.

8. A device as in claim 1, wherein said washer includes a lateral tensioning member that provides a tensioning force in a horizontal direction.

9. A device as in claim 8, wherein said lateral tensioning member comprises a lug extending beyond the diameter of said washer, said lug constructed to resist horizontal compression.

10. A device as in claim 9, wherein said interior defines an inset for said washer, said inset defining a notch for correspondingly receiving said lug, the notch positioned to relieve horizontal compression acting on said washer.

11. A device as in claim 10, wherein said lug engages said notch to produce an audible indication thereof.

12. A device as in claim 1, wherein said housing further comprises integral supports in said housing interior, said supports enhancing structural integrity.

13. A device as in claim 1, further comprising a handle mounted through said housing to rotate said cam.

14. A device as in claim 13, wherein said handle includes a graduated shaft, said graduated shaft having a top portion and a bottom portion, said bottom portion defining an opening for receiving a connector.

15. A device as in claim 14, said cam including a graduated aperture for receiving said graduated shaft.

16. A window locking mechanism, comprising:

a keeper defining an internal cavity;

a housing constructed to form a keeper recess to fit enclosably over at least part of said keeper; and engagement means for said keeper to engage the keeper recess such that more than about 50 percent of the surface area of said keeper engages the keeper recess within said housing.

17. A window locking mechanism as in claim 16, wherein said engagement means comprises a wedge that urges said keeper to engage the keeper recess within said housing.

18. A window locking mechanism as in claim 16, wherein said engagement means comprises a slotted cam rotatively positioned within said housing that urges said keeper to engage the keeper recess within said housing.

19. A window locking mechanism as in claim 16, wherein said engagement means urges said keeper to engage said keeper recess such that about all of the surface area of said keeper engages said keeper recess.

20. A window locking mechanism as in claim 16, wherein said engagement means comprises a solid cam rotatively positioned within said housing, said cam engaging the keeper cavity and urging said keeper to engage the keeper recess within said housing.

21. A window locking mechanism as in claim 16, wherein said keeper includes a raised portion for engaging the keeper recess.

22. A window unit having a locking mechanism, said locking mechanism comprising:

a keeper defining an internal cavity;

a housing constructed to form a keeper recess to fit enclosably over at least part of said keeper, said housing defining a first tier-recess combination and a second tier-recess combination;

a cam rotatively positioned within said first tier-recess combination; and a washer positioned between said housing and said cam, wherein said second tier-recess combination extends along at least a portion of said housing, wherein said keeper is nestable within the second tier-recess combination.

23. A window unit having a locking mechanism as in claim 22, said locking mechanism comprising a metal material.

24. A window unit having a locking mechanism as in claim 22, said locking mechanism comprising a plastic material.

25. A window unit having a locking mechanism as in claim 22, wherein said cam is substantially D-shaped.

26. A window unit having a locking mechanism as in claim 22, wherein said locking mechanism includes a handle mounted through said first tier-recess combination to rotate said cam.

27. A window unit having a locking mechanism as in claim 26, wherein said handle includes a graduated shaft, said graduated shaft having a top portion and a bottom portion, said bottom portion defining an opening for receiving a connector.

28. A window unit having a locking mechanism as in claim 27, said cam including a graduated aperture for receiving said graduated shaft.

29. A window unit having a locking mechanism as in claim 22, wherein said housing is mounted to a window sash or a window frame.

30. A window unit having a locking mechanism as in claim 22, wherein said keeper is mounted to a window sash or a window frame.

* * * * *